US007426281B2

(12) United States Patent
Hoffmann

(10) Patent No.: US 7,426,281 B2
(45) Date of Patent: Sep. 16, 2008

(54) ELECTRODYNAMIC ACOUSTIC TRANSDUCER

(75) Inventor: Patrick Hoffmann, Villons-les-Buissons (FR)

(73) Assignee: Rötelzeichnung Holding A.G., Luxembourg (LU)

( * ) Notice: Subject to any disclaimer, the term of this patent is extended or adjusted under 35 U.S.C. 154(b) by 275 days.

(21) Appl. No.: 10/544,177

(22) PCT Filed: Feb. 6, 2004

(86) PCT No.: PCT/IB2004/000298

§ 371 (c)(1),
(2), (4) Date: Aug. 2, 2005

(87) PCT Pub. No.: WO2004/071128

PCT Pub. Date: Aug. 19, 2004

(65) Prior Publication Data

US 2006/0147076 A1 Jul. 6, 2006

(30) Foreign Application Priority Data

Feb. 10, 2003 (FR) ..... 03 01521

(51) Int. Cl.
*H04R 25/00* (2006.01)

(52) U.S. Cl. ..... 381/339; 381/340; 381/343; 381/430

(58) Field of Classification Search ..... 381/339, 381/40, 341, 342, 343, 423, 430, 397, 160; 181/152, 153, 154, 155, 185, 187, 191, 192, 181/199

See application file for complete search history.

(56) References Cited

U.S. PATENT DOCUMENTS

| | | | | |
|---|---|---|---|---|
| 1,707,617 A | | 4/1929 | Kellogg | |
| 4,525,604 A | * | 6/1985 | Frye | 381/343 |
| 4,776,428 A | * | 10/1988 | Belisle | 181/185 |
| 5,701,358 A | | 12/1997 | Larsen et al. | |
| 5,987,148 A | * | 11/1999 | Hsieh | 381/397 |

FOREIGN PATENT DOCUMENTS

| | | |
|---|---|---|
| EP | 0 077 228 A | 4/1983 |
| FR | 610 959 A | 8/1926 |
| GB | 1 591 184 A | 6/1981 |
| GB | 1 591 184 A | 6/1981 |

OTHER PUBLICATIONS

International Search Report.

* cited by examiner

*Primary Examiner*—Huyen D Le
(74) *Attorney, Agent, or Firm*—Collard & Roe, P.C.

(57) ABSTRACT

The invention relates to an acoustic transducer generating a sound radiation by compression and expansion of an air mass situated between a mobile membrane and a fixed surface or between two mobile membranes. The present invention concerns a transducer or acoustic loudspeaker of electrodynamic type designed to emit sound waves from a modulated electrical signal. The particular arrangement of the constituent elements of the transducer as presented in the invention enables the generation of an acoustic radiation by compression and expansion of the air mass located between a mobile membrane and a fixed surface or anvil which are distinguished by being placed opposite one another. The direction of the resulting acoustical wave is perpendicular to the direction of displacement of the membrane. This manner of generating an acoustic wave enables the production of transducers with specific electroacoustic directivity characteristics.

9 Claims, 5 Drawing Sheets

ELECTRODYNAMIC ACOUSTIC TRANSDUCER

CROSS REFERENCE TO RELATED APPLICATIONS

Applicant claims priority under 35 U.S.C. §119 of French Application No. FR 0301521 filed Feb. 10, 2003. Applicant also claims priority under 35 U.S.C. §365 of PCT/IB2004/000298 filed Feb. 6, 2004. The international application under PCT article 21(2) was not published in English.

The present invention concerns an acoustical transducer or electrodynamic loudspeaker designed to emit sound waves resulting from a modulated signal.

BACKGROUND OF THE INVENTION—FIGS. 1-4.

Traditional transducers or loudspeakers (as illustrated in FIGS. 1 and 2 comprise a chassis (13 and 23), usually of metal on which the various active components, a mobile membrane (17 and 27) with its suspension (18 and 28) together with a driver (14 to 16 and 24 to 26) which imparts motion to the membrane. The driver can be of electromagnetic, piezoelectric or electrostatic type. The mobile membrane generates a resulting acoustic wave (11 and 21) in the direction of its displacement (12 and 22) as a function of the electric current which modulates the sound signal to be reproduced. FIG. 1 illustrates in cross section a transducer provided with a membrane of large dimension, more appropriate to the reproduction of medium to low frequencies. FIG. 2 illustrates, in cross section a transducer which is designed more specifically for the reproduction of high frequencies and which is characterized by a smaller membrane, which generally includes a coil, located about its periphery. To this transducer may be added an acoustical horn, enabling an improvement of its output by providing a better acoustic coupling between the membrane (solid) and the ambient environment (air) by a more progressive transition of pressure waves. These transducers of which a great number of variations exist, are chiefly characterized by the direction of the resulting sound wave, which is parallel to the direction of the membrane displacement. Their acoustical radiation is not uniform in all directions with the exception of particular configurations known as pulsating spheres, whose resultant sound radiation is always parallel to the direction of the displacement of the membrane.

Another type of transducer the ESS loudspeaker, invented in the U.S.A. by Dr Oscar Heil (the principle being illustrated in FIG. 3) consists of a folded membrane (37) on which is printed a conductive ribbon; this membrane is positioned in the air gap (36) of a magnetic circuit (35) enabling the magnetic induction to be distributed over the entire membrane. This arrangement, by contraction and expansion (32) of the folds of the membrane, according to the modulating current, results in aspiration and expulsion of the air situated between these folds, and thus in the generation of a resulting acoustic wave (31). in spite of the very high quality of the sound produced, the sound radiation is markedly directional, and furthermore the very weak amplitude of the movements of the folds of this membrane does not enable the reproduction low frequencies.

A third type of transducer, (illustrated in FIG. 4) invented by Sawafugi and Tadashi is a development of an acoustic transducer operating by the deflections of a symmetrical flexible membrane (47). It activates two flexible symmetrical membranes, both attached at one end to a case (43), which are subject to alternating compression and recoil energised by a flat mobile coil (49) located in the air gaps (46) of two magnets (44). The operation of this transducer, being very compact, depends on the symmetrical displacement of the membrane and does not allow any particular directional characteristics.

The auditory spectrum perceptible to man from 20 to 20000 hertz approximately is characterized by the very great variety of wavelength differences involved, ranging from one millimeter to several meters. The reproduction of all these frequencies at acceptable level of power must be achieved by means of two or more loudspeakers, each of which is responsible for a part of the sound spectrum. The result of this necessity is that the acoustic centers of these loudspeakers are several decimeters apart. This degrades the precision and spatial restitution of the stereo signal reproduced and introduces a phenomenon of acoustic interference known as directivity lobes, giving rise to very significant variations of acoustic power emitted depending on the position of the listener in relation to the different transducers. This phenomenon accentuates the undesirable directivity characteristics inherent in traditional loudspeakers.

SUMMARY OF THE INVENTION

The particular arrangement of the constituent parts of the transducer, subject of the invention, enables the generation of an acoustic radiation according the modulating current applied, by compression and expansion of the mass of air situated between the mobile membrane, flexibly mounted, by means of a suspension arrangement, on a rigid chassis, and a fixed rigid surface herein referred to as anvil, which is also attached rigidly to the same chassis. As this membrane and this anvil are characterized by being positioned opposite one another, the resulting acoustic waves are perpendicular to the direction of the displacement of the membrane. The distance separating the membrane from the rigid fixed surface is slightly more than half the maximum displacement of the membrane, in order to avoid any risk of contact between these two elements. This mode of acoustic sound generation enables the elaboration of electro transducers having characteristics of directivity different to those of traditional loudspeakers. The driving of the membrane according to the modulation current can be achieved by means of an electromagnetic type of drive as shown in the drawings illustrating the invention, but this drive can also be of piezoelectric type (as illustrated in FIG. 10) or of electrostatic or of other types.

BRIEF DESCRIPTION OF THE DRAWINGS FIGURES

Figure 8:
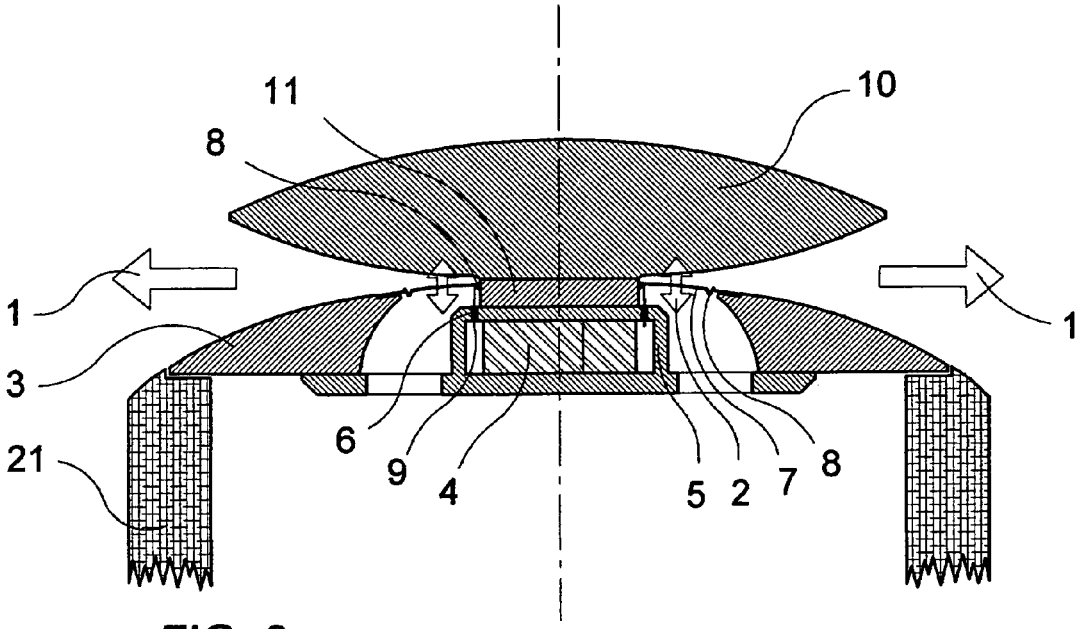
Figure 9:
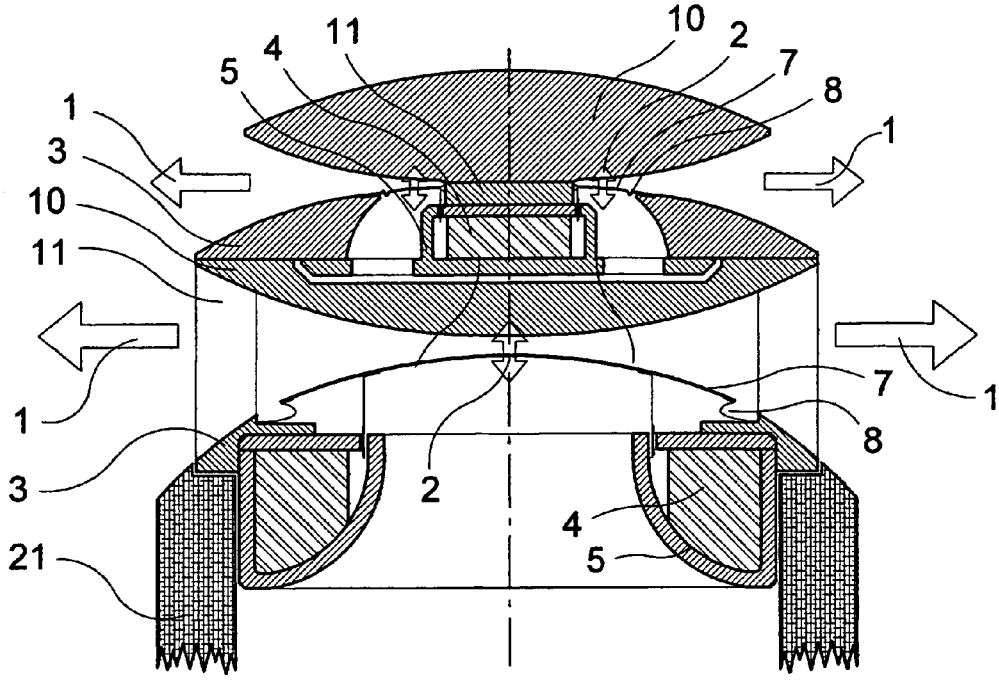

FIG. 8 illustrates this omnidirectional transducer with ring membrane, in section view FIG. 9 illustrates in section, the stacked arrangement of two omnidirectional transducers having the same axis, each one responsible for the reproduction of a part of the audible spectrum (low and lower medium frequencies emanating from the lower membrane, and upper medium and high frequencies emanating from the higher membrane).

Figure 10:
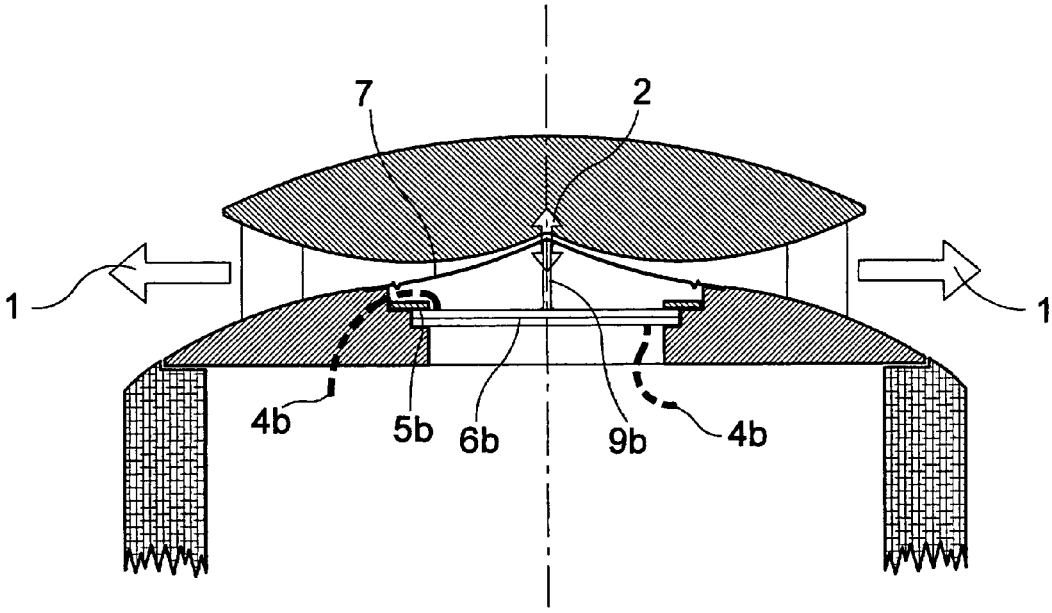

FIG. 10 illustrates the present invention in axonometric view with controlled directivity arrangement.

Figure 11:
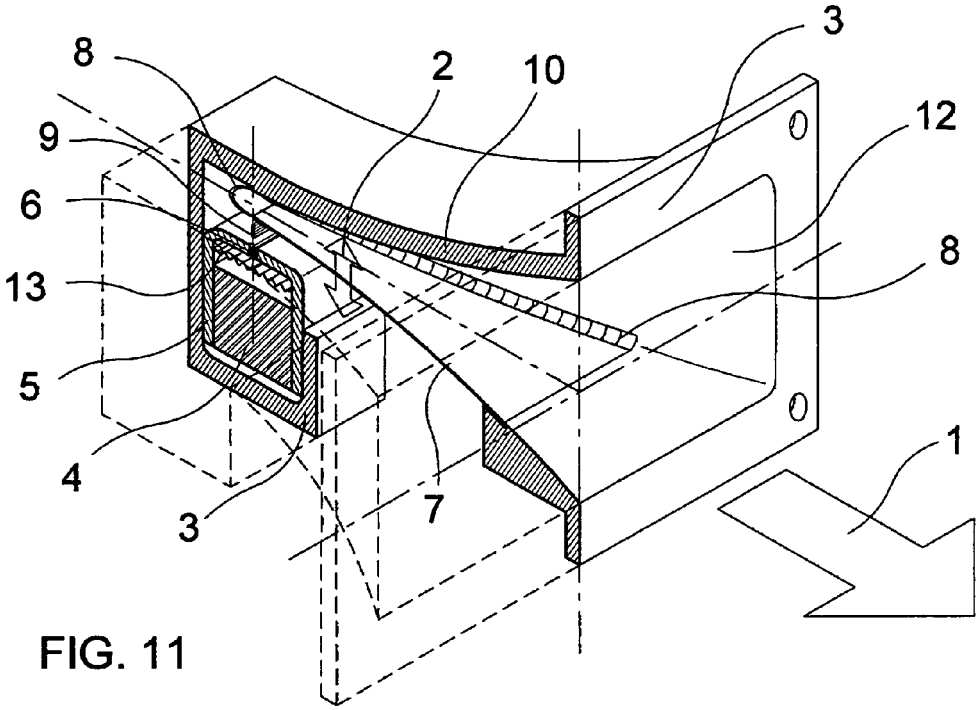

FIG. 11 illustrates in section the transducer shown in FIG. 10.

Figure 12:
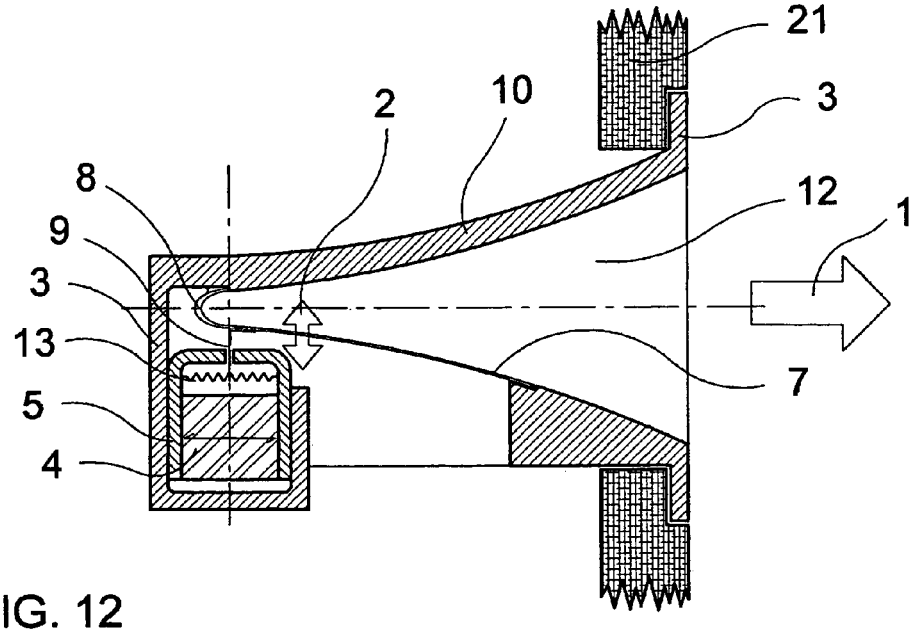

FIG. 12 shows a side sectional view of the embodiment shown in FIG. 11.

In order to indicate elements in the different figures that have the same function in different embodiments, the reference numbers appearing on the drawings figures are preceded, in the description and the claims, by the digit of the figure to which this description refers. For example, membrane (9) in FIG. 5 is designated (59) in the description; the same membrane (9) in FIG. 6 is designated (69) in the description.

DETAILED DESCRIPTION OF THE BEST EMBODIMENTS OF THE INVENTION

Figure 1:
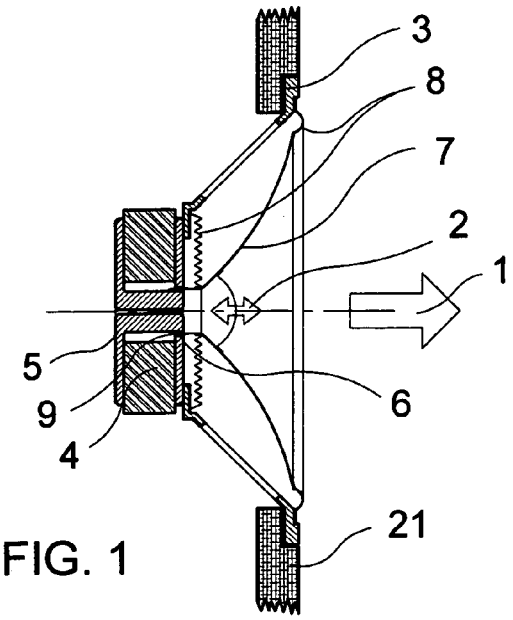
FIG. 1 illustrates in cross section a traditional transducer having a large membrane designed to reproduce medium to low frequencies.
Figure 2:
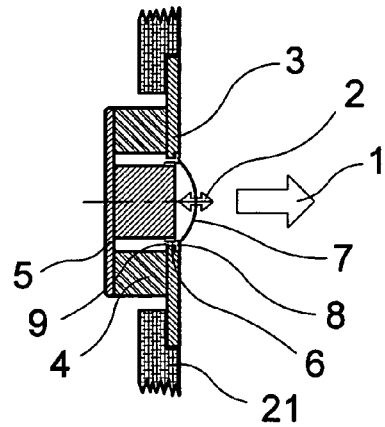
FIG. 2 illustrates in cross section a traditional transducer designed for the reproduction of high frequencies characterized by having a smaller membrane.
Figure 3:
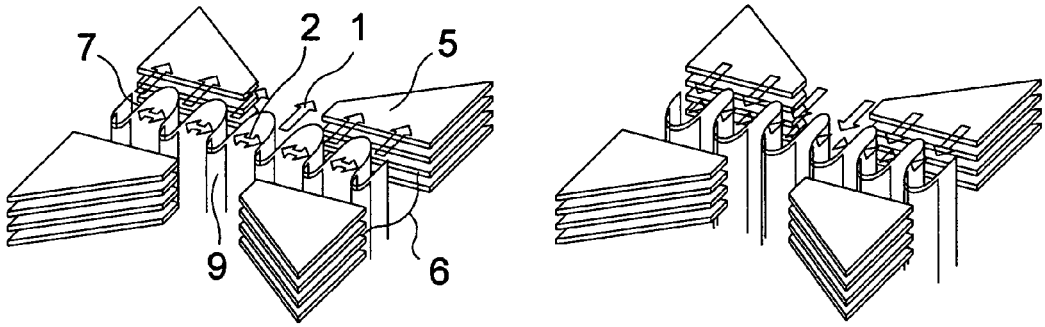
FIG. 3 illustrates schematically and in axonometric view the operating principal of a membrane with folds, only part of the membrane the electrical circuit and the magnetic circuit being illustrated.
Figure 4:
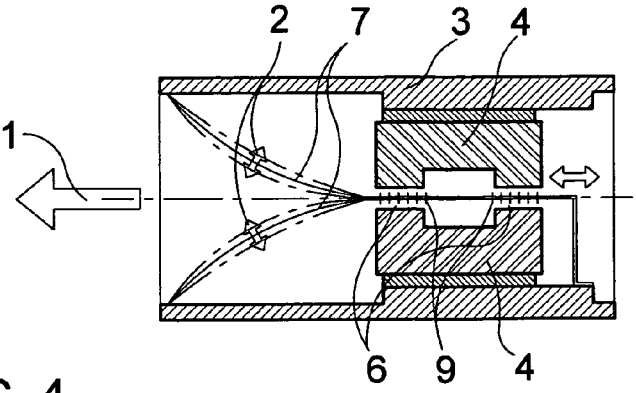
FIG. 4 illustrates in cross section a transducer of the Sawafugi and Tadashi type equipped with two flexible symmetrical membranes.
Figure 5:
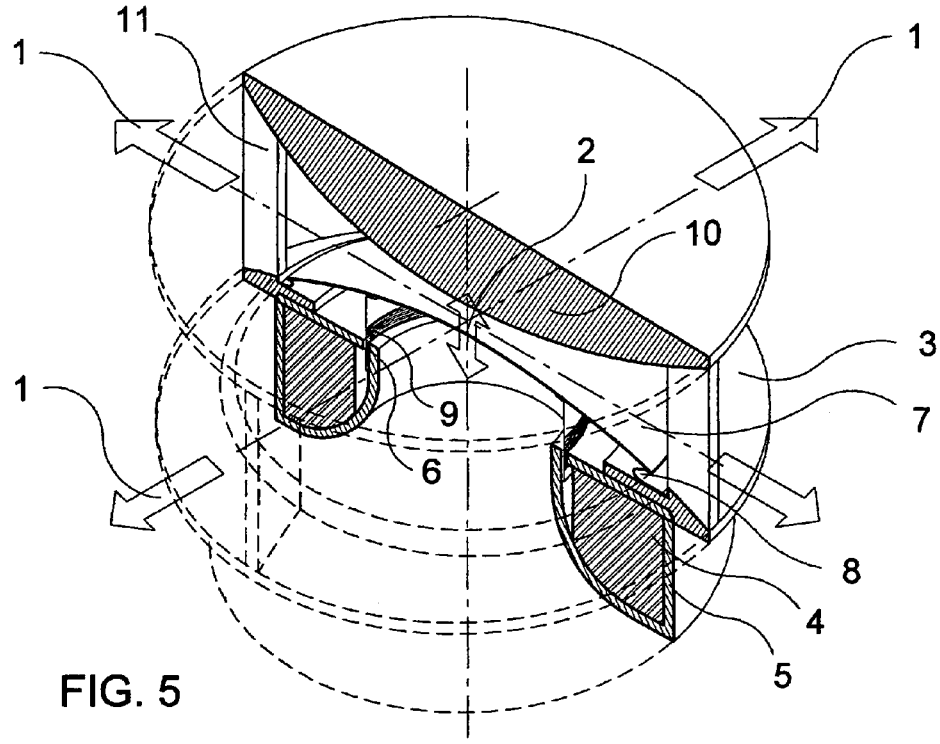
FIG. 5 illustrates in axonometric view the transducer, subject of the present invention, configured for omnidirectional acoustic radiation, equipped with a dome shaped membrane. This membrane enables the reproduction of low and medium frequencies.
Figure 6:
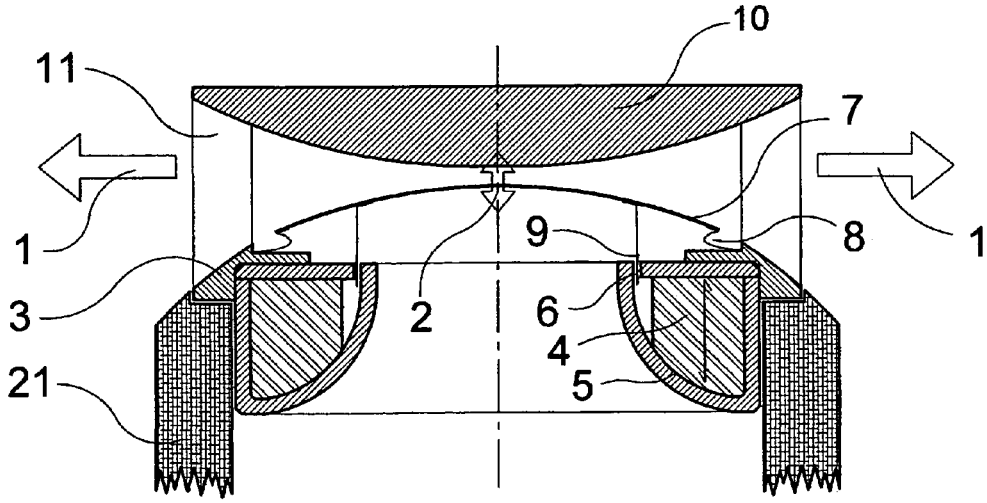
FIG. 6 illustrates the same transducer in section view.

A first embodiment is illustrated in FIGS. 5 and 6. The acoustic transducer according to the invention is composed of a rigid chassis (53 and 63) on which are attached:

- A magnetic core (55 and 65) coupled to a magnetic armature (54 and 64) designed to create a magnetic field in between magnetic poles (56 and 66).
- A moving membrane (57 and 67) mounted on a flexible peripheral suspension (58 and 68) incorporating a moving coil (59 and 69) suspended in the air gap (56 and 66). This membrane here illustrated in the form of a convex dome will have a shape commensurate with a high degree of rigidity. This membrane may incorporate fold or corrugations about its periphery, designed to form all or part of its suspension (58 and 68).
- A fixed and rigid surface known as "anvil" (510 and 610), located opposite the mobile membrane (57 and 67) and rigidly attached to (511 and 611) to the chassis or forming an integral part of the latter.

This transducer is characterized by the arrangement of its elements, which create an omnidirectional acoustic transducer, that is to say generating a resulting sound radiation (51 and 61) through 360° in a plane perpendicular to the direction of displacement (52 and 62) of its membrane. The shape, profile and dimension of the different elements depend on their electrical or mechanical characteristics as well as the spectrum of frequencies to be reproduced. This transducer if it is intended to produce low or medium frequencies may be coupled to an enclosure in order to restitute or absorb the acoustic energy generated at the rear of the membrane.

Figure 7:
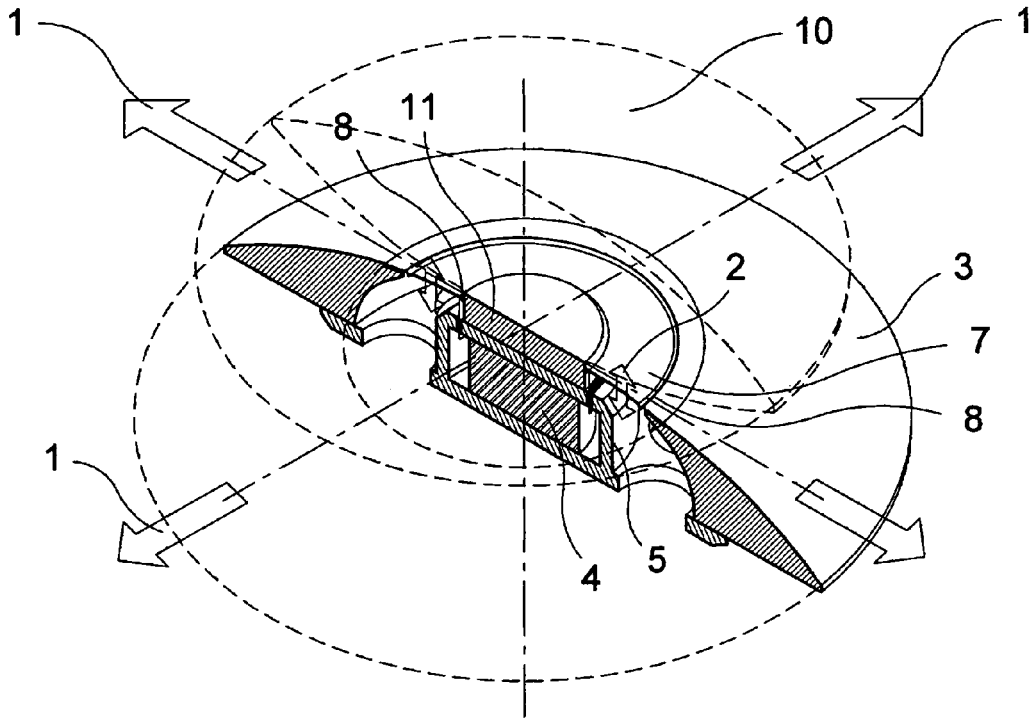
FIG. 7 illustrates the present invention in section view, in omnidirectional configuration with a ring membrane, specifically designed for the reproduction of high frequencies. The anvil (FIG. 10) is illustrated in dotted line, to clarify the depiction of this embodiment.

FIGS. 7 and 8 represent an alternative embodiment of the omnidirectional transducer. It comprises a rigid chassis (73 and 83) on which are fixed:

- A magnetic circuit (75 and 85) coupled to a magnet (74 and 84) resulting in the creation of a magnetic field in an air gap (76 and 86).
- A mobile ring-shaped membrane (77 and 87) mounted on a flexible peripheral internal and external suspension (78 and 88) incorporating a moving coil (79 and 89) suspended in air gap (76 and 86). This membrane may incorporate folds or corrugations about its periphery, designed to form part of its suspension. The FIGS. 7 and 8 show such an arrangement for its external peripheral suspension.
- A fixed and rigid surface, known as anvil (710 and 810) located opposite the mobile ring shaped membrane, (77 and 87) and attached (711 and 811) rigidly to the assembly of other non-moving components of the transducer.

This arrangement with ring-shaped membrane allows the use of the effective surface of the membrane compatible with a high acoustical power whilst avoiding acoustic phase opposition which arises with this type of transducer when the membrane-anvil interface radial length is too close to that of the length of the frequencies to be reproduced. This arrangement is more particularly intended for the reproduction high frequencies that are of short wavelength.

With reference to FIG. 9, it is possible, in order to reproduce an extended spectrum of audible frequency, to superimpose on an axis parallel to the direction of displacement of the moving membranes (92) two or more of these omnidirectional transducers, each being allocated a specific range of frequencies. The limited height of each transducer enables a closer proximity of acoustic centers of the different transducers and hence the reduction of directional lobes inherent in the combination of traditional transducers. All the references in this figure relate to similar functional elements in FIGS. 5 to 8 described previously.

FIG. 10 illustrates a variation of the first embodiment proposed. Its particularity consists in the drive of the membrane (107) by a device composed of a bar of piezoelectric crystal, homogenous or composite, (106*b*) which deflects according to modulation current applied to the bar via electrical connections (104*b*). The displacements resulting from the deflections of the bar (106*b*) are mechanically transferred to membrane via a rigid a lightweight element (109*b*). The resulting sound radiated is perpendicular to the direction of displacement of the membrane (107). The shape, profile and dimension depend on the electrical and mechanical characteristics as well as the spectrum of frequency reproduced. The other elements of the arrangement according to FIG. 10 are identical in their functions to the equivalent elements of the first embodiment as illustrated in FIGS. 5 and 6.

The embodiment of the invention represented in FIGS. 11 and 12 consists of another arrangement of the different elements of the transducer by a compression and expansion of the air mass located between a mobile membrane attached with suspension to a rigid chassis and a fixed and rigid surface known as anvil, also rigidly attached to the same chassis, the said membrane and anvil being placed opposite one another. The direction of the resulting acoustical wave (111 and 121) is perpendicular to the displacement of the membrane (112 and 122).

This Embodiment Comprises

- A rigid chassis (113 and 123).
- A magnet (114 and 124) coupled to magnetic circuit (115 and 125) and designed to create a magnetic field in the air gap (116).
- A mobile membrane (117 and 127) mounted on a flexible suspension including a moving coil (119 and 129) suspending in the air gap, the moving coil being guided by a second suspension (1113 and 1213) designed to ensure centralization of the coil in the air gap.

A fixed and rigid surface (1110 and 1210) located opposite the mobile membrane and attached rigidly to the chassis or forming an integral part of the latter.

Baffles (1112 and 1212), rigid or otherwise perpendicular to the membrane and the anvil surface, their role being to physically limit the air mass between the membrane and the anvil. These baffles may form an integral part of the chassis (113 and 123).

This embodiment allows a precise directivity of acoustic radiation according to the form, geometric configuration, and dimensions of the membrane, anvil, baffles and chassis and according to the spectrum of frequencies to be reproduced. This transducer, if designed to reproduce low or medium frequencies, may be coupled to an enclosure (1221) designed to capture or absorb the acoustical energy generated at the rear of the mobile membrane.

APPLICATION AND MANUFACTURING POSSIBILITIES

The manufacture of this type of transducer is identical to that of traditional acoustic transducers or loudspeakers.

In materials and manufacture:

Chassis and anvil in metal or synthetic or composite materials or wrought or pressed steel or die cast metals or resin containing fiber for consolidation or strength.

Membrane in metal, treated or untreated paper, synthetic or composite fibers or non-fibrous materials.

Suspension in natural or synthetic rubber or other synthetic material. This suspension may equally comprise folds or corrugations formed in the membrane of the transducer.

Magnets, armatures, magnetic circuits and coils of conventional construction.

Generally speaking, this description includes all current and future materials and methods of manufacture, adapted to the manufacture and improvement of this type of transducer.

In its applications and uses:

This will correspond and be adapted to the characteristics and specific functioning of this type of transducer. Drivers of electromagnetic, peizoelectric, electrostatic or other type, as well as analog or digital processes of control and driving of all mobile parts, may be applied to this type of transducer.

The type of transducer as presented in the invention may include a device commonly called a "horn" which enables the enhancement of its power output by an improved acoustic coupling between the membrane and the ambient air by a progressive transition of pressures.

The type of transducer as presented in the invention may be utilized in other fluid media, gas or liquid other than air.

The invention claimed is:

1. An electroacoustical transducer comprising:

a chassis (3);

a rigid surface (10) rigidly attached to said chassis (3);

a moving membrane (7), attached flexibly to said chassis (3) and positioned to face said rigid surface (10), with an air mass between said rigid surface (10) and said moving membrane (7), where in a distance between the rigid surface and the moving membrane increases in size from a center to a periphery; and a driving device (4,5,9,9*b*) to displace said moving membrane (7) in the direction of said rigid surface activated by a modulating electric current;

the displacement of said membrane (7) generating, by compression and expansion of said air mass, an acoustic wave, of which the direction of propagation (1) is essentially perpendicular to the direction (2) of displacement of said membrane (7).

2. An electroacoustical transducer as set forth in claim 1, wherein said rigid surface (10) and said moving membrane (7) are configured in cylindrical symmetry about an axis that is parallel to the direction (2) of displacement of said moving membrane (7); and the resulting sound radiation is omnidirectional in a plane perpendicular to said direction (2) of displacement of said moving membrane (7).

3. An electroacoustical transducer as set forth in claim 1, wherein said rigid surface (10) is shaped in the form of a convex dome.

4. An electroacoustical transducer according to claim 3, wherein said moving membrane (7) also is shaped in the form of a convex dome.

5. An electroacoustical transducer as set forth in claim 3, wherein said moving membrane (7) is ring shaped.

6. An electroacoustical transducer according to claim 1 comprising acoustic screens or baffles (12) arranged to be in a plane that is perpendicular to said moving membrane (7) and said rigid surface (10), in such a way as to limit the air mass contained between them, the resulting sound radiation being directional.

7. An electroacoustical transducer as set forth in claim 1, comprising an acoustic horn that enables the improvement of the acoustic coupling between moving membrane (7) and the ambient air.

8. An electroacoustical transducer as set forth in claim 1, wherein said device of driving is an electromagnetic (4,5,9), piezoelectric, (9*b*) or electrostatic device.

9. An array consisting of multiple electroacoustical transducers as set forth in claim 1, each adapted to the reproduction of a determined range of frequencies, stacked on an axis that is parallel to the direction of displacement of said moving membrane (7).

* * * * *